US008867750B2

(12) United States Patent
Brown

(10) Patent No.: US 8,867,750 B2
(45) Date of Patent: Oct. 21, 2014

(54) SURROUND SOUND VIRTUALIZER AND METHOD WITH DYNAMIC RANGE COMPRESSION

(75) Inventor: C. Phillip Brown, Castro Valley, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 474 days.

(21) Appl. No.: 13/132,570

(22) PCT Filed: Dec. 1, 2009

(86) PCT No.: PCT/US2009/066230

§ 371 (c)(1),
(2), (4) Date: Jun. 2, 2011

(87) PCT Pub. No.: WO2010/074893

PCT Pub. Date: Jul. 1, 2010

(65) Prior Publication Data

US 2011/0243338 A1 Oct. 6, 2011

Related U.S. Application Data

(60) Provisional application No. 61/122,647, filed on Dec. 15, 2008.

(51) Int. Cl.

| | |
|---|---|
| ***H04R 5/00*** | (2006.01) |
| ***H04S 3/00*** | (2006.01) |
| ***H04S 3/02*** | (2006.01) |

(52) U.S. Cl.

CPC ..... *H04S 3/002* (2013.01); *H04S 2420/01* (2013.01); *H04S 3/02* (2013.01)

USPC ..... 381/17; 381/310

(58) Field of Classification Search

None

See application file for complete search history.

(56) References Cited

U.S. PATENT DOCUMENTS

| | | | |
|---|---|---|---|
| 4,118,599 | A | 10/1978 | Iwahara |
| 5,471,651 | A | 11/1995 | Wilson |

(Continued)

FOREIGN PATENT DOCUMENTS

| | | |
|---|---|---|
| RU | 2006122948 | 1/2008 |
| RU | 2347282 | 2/2009 |

(Continued)

OTHER PUBLICATIONS

Brown, et al., "A Structural Model for Binaural Sound Synthesis" IEEE Transactions on Speech and Audio Processing, IEEE Service Center, New York, US, vol. 6, No. 5, Sep. 1, 1998.

(Continued)

*Primary Examiner* — Joseph Saunders, Jr.
*Assistant Examiner* — James Mooney

(57) ABSTRACT

Method and system for generating output signals for reproduction by two physical speakers in response to input audio signals indicative of sound from multiple source locations including at least two rear locations. Typically, the input signals are indicative of sound from three front locations and two rear locations (left and right surround sources). A virtualizer generates left and right surround outputs useful for driving front loudspeakers to emit sound that a listener perceives as emitting from rear sources. Typically, the virtualizer generates left and right surround outputs by transforming rear source inputs in accordance with a head-related transfer function. To ensure that virtual channels are well heard in the presence of other channels, the virtualizer performs dynamic range compression on rear source inputs. The dynamic range compression is preferably accomplished by amplifying rear source inputs or partially processed versions thereof in a nonlinear way relative to front source inputs.

24 Claims, 6 Drawing Sheets

Virtualizer Block Diagram

(56) References Cited

U.S. PATENT DOCUMENTS

| | | | | |
|---|---|---|---|---|
| 6,449,368 | B1 | 9/2002 | Davis | |
| 6,937,737 | B2 * | 8/2005 | Polk, Jr. | 381/300 |
| 7,177,431 | B2 | 2/2007 | Davis | |
| 7,551,745 | B2 | 6/2009 | Gundry | |
| 2003/0169886 | A1 | 9/2003 | Boyce | |
| 2004/0213420 | A1 * | 10/2004 | Gundry et al. | 381/104 |
| 2006/0115091 | A1 | 6/2006 | Kim | |

FOREIGN PATENT DOCUMENTS

| | | |
|---|---|---|
| RU | 2364053 | 8/2009 |
| SU | 1626410 | 2/1991 |
| WO | 9820709 | 5/1998 |
| WO | 03/053099 | 6/2003 |
| WO | 2007/110103 | 10/2007 |

OTHER PUBLICATIONS

Schroeder, M.R., "Natural Sounding Artificial Reverberation" Bell Telephone System Technical Publication Monograph, Nov. 1, 1962, pp. 1-05.

Kim, S., et al., "Adaptive Virtual Surround Sound Rendering Method for an Arbitrary Listening Position" AES 30th International Conference, Saariselka, Finland, Mar. 15-17, 2007, pp. 1-8.

Gardner, William G., "Transaural 3-D Audio", MIT Media Laboratory Perceptual Computing Section Technical Report No. 342, Jul. 6, 1995, pp. 1-7.

Kendall, Gary S., "The Decorrelation of Audio Signals and Its Impact on Spatial Imagery" Computer Music Journal pp. 71-87, vol. 19, Winter 1995 Massachusetts Institute of Technology.

Walsh, et al., "Loudspeaker-Based 3-D Audio System Design Using the M-S Shuffler Matrix" Audio Engineering Society Convention Paper 6949, presented at the 121st Convention, Oct. 5-8, 2006, San Francisco, USA, pp. 1-17.

Schroeder, M.R., "Natural Sounding Artificial Reverberation" Journal of the Audio Engineering Society, Jul. 1962, vol. 10, No. 3, pp. 219-223.

Busson, et al., "Subjective Investigations of the Interaural Time Difference in the Horizontal Plane" AES Convention Paper 6324, presented at the 118th Convention May 28-31, 2005, Barcelona, Spain, pp. 1-12.

Rudolph Barry, "Understanding Compressors and Compression" Nov. 26, 2004, pp. 1-8.

"Compression" Wikirecording, Oct. 28, 2008, pp. 1-5.

Preliminary Search conducted by Dolby internal in Mar. 11, 2008 and Mar. 13, 2008 (see attached files).

Duda, et al., "Range Dependence of the Response of a Spherical Head Model" J. Acoust. Soc. Am., vol. 104, No. 5, Nov. 1998, pp. 3048-3058.

Woodworth, et al., "Exprimental Psychology" Holt and Co., pp. 349-361, 1954.

Gardner, William G., "3-D Audio Using Loudspeakers" Springer, 1998 Technology and Engineering 154 pages.

Vigovsky, Alexander, "AC3Filter Loudness and Dynamic Range" Feb. 2009 on 26 pages.

Surround Sound. Decorrelation of Surround Signals.

* cited by examiner

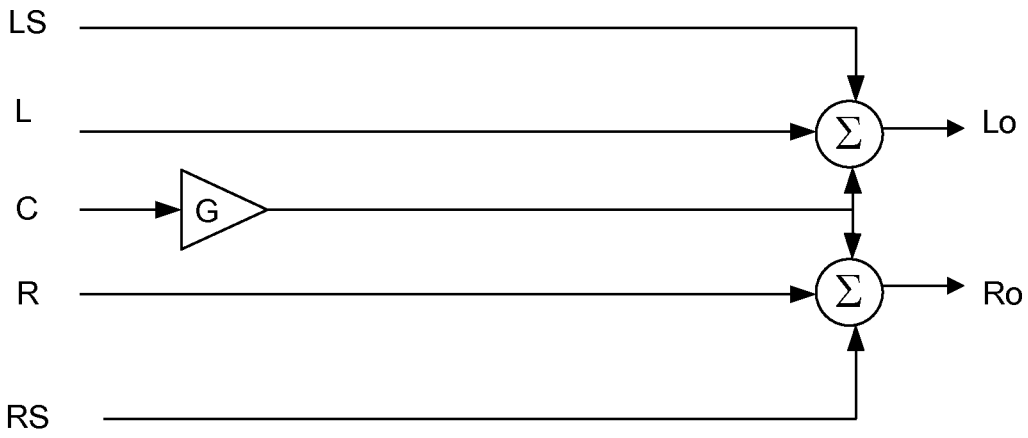
Fig. 1 Stereo Mix
(prior art)
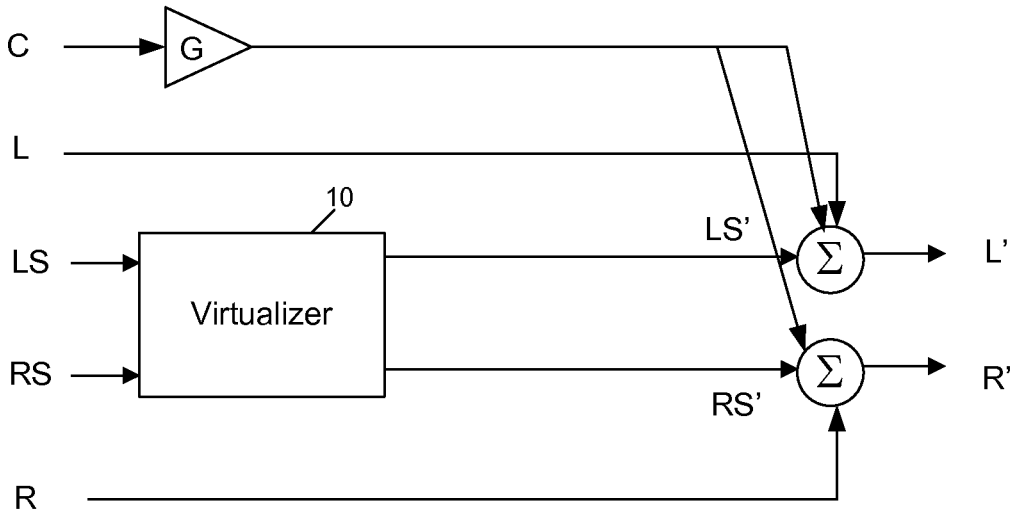
Fig. 2 Virtualizer Mix
(prior art)

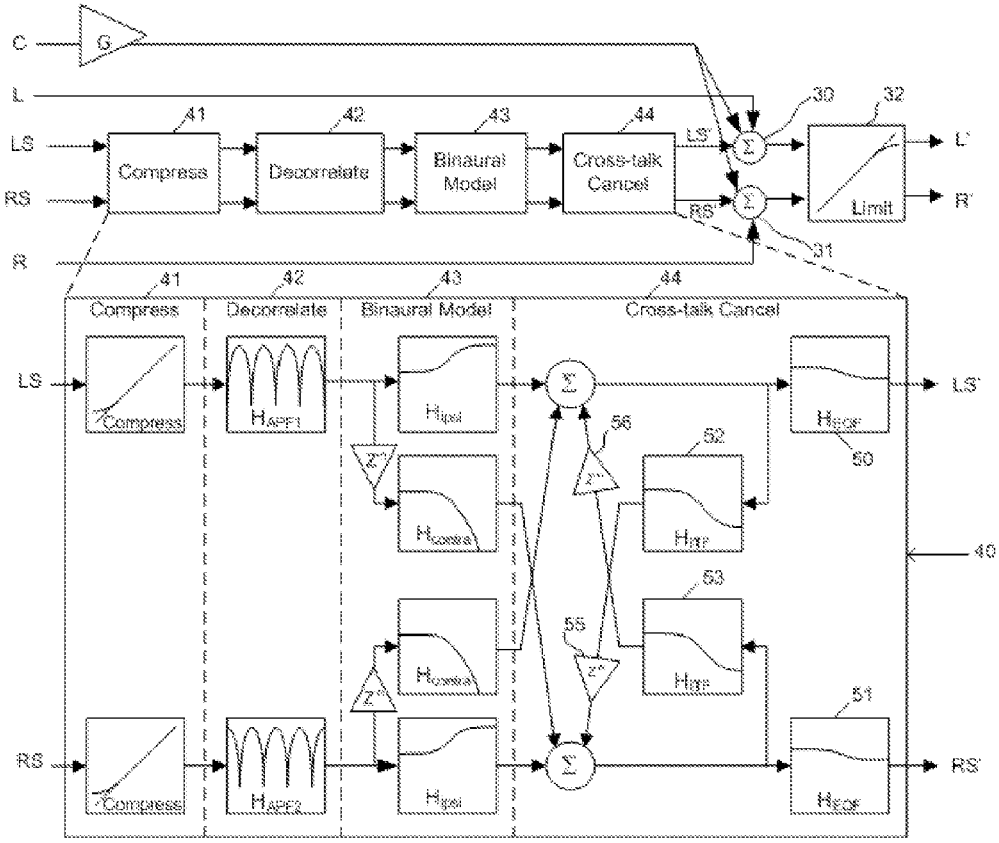
Figure 3 – Virtualizer Block Diagram
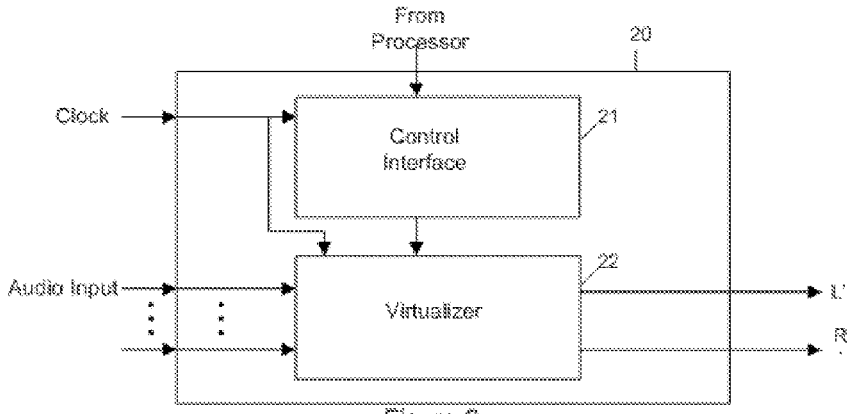
Figure 9

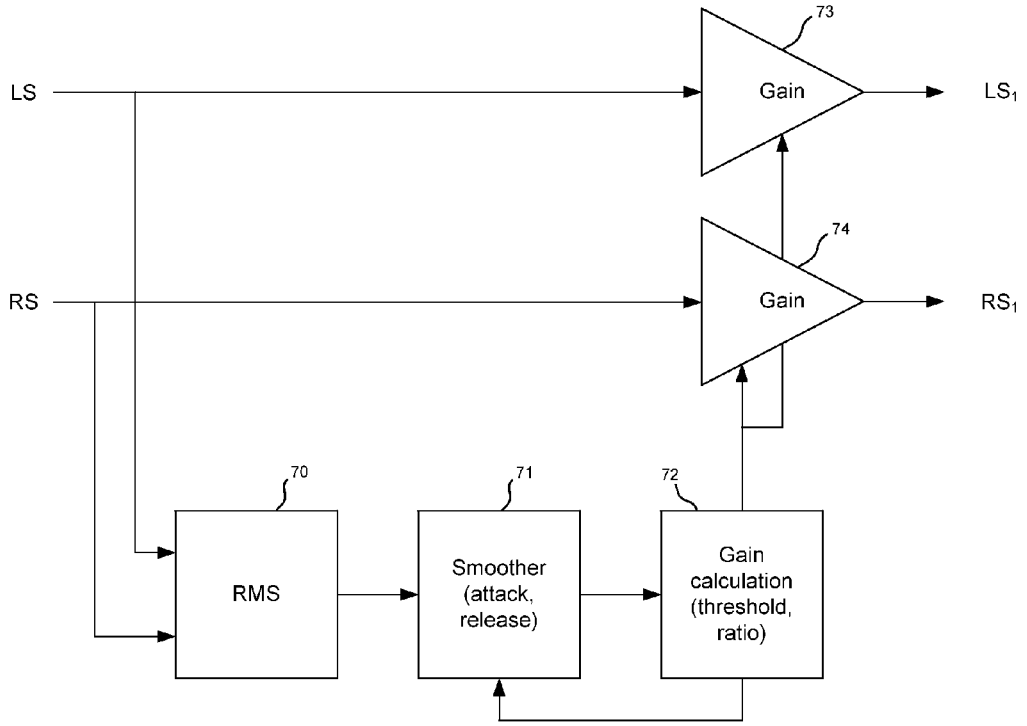
Figure 4 – Dynamic Range Compressor

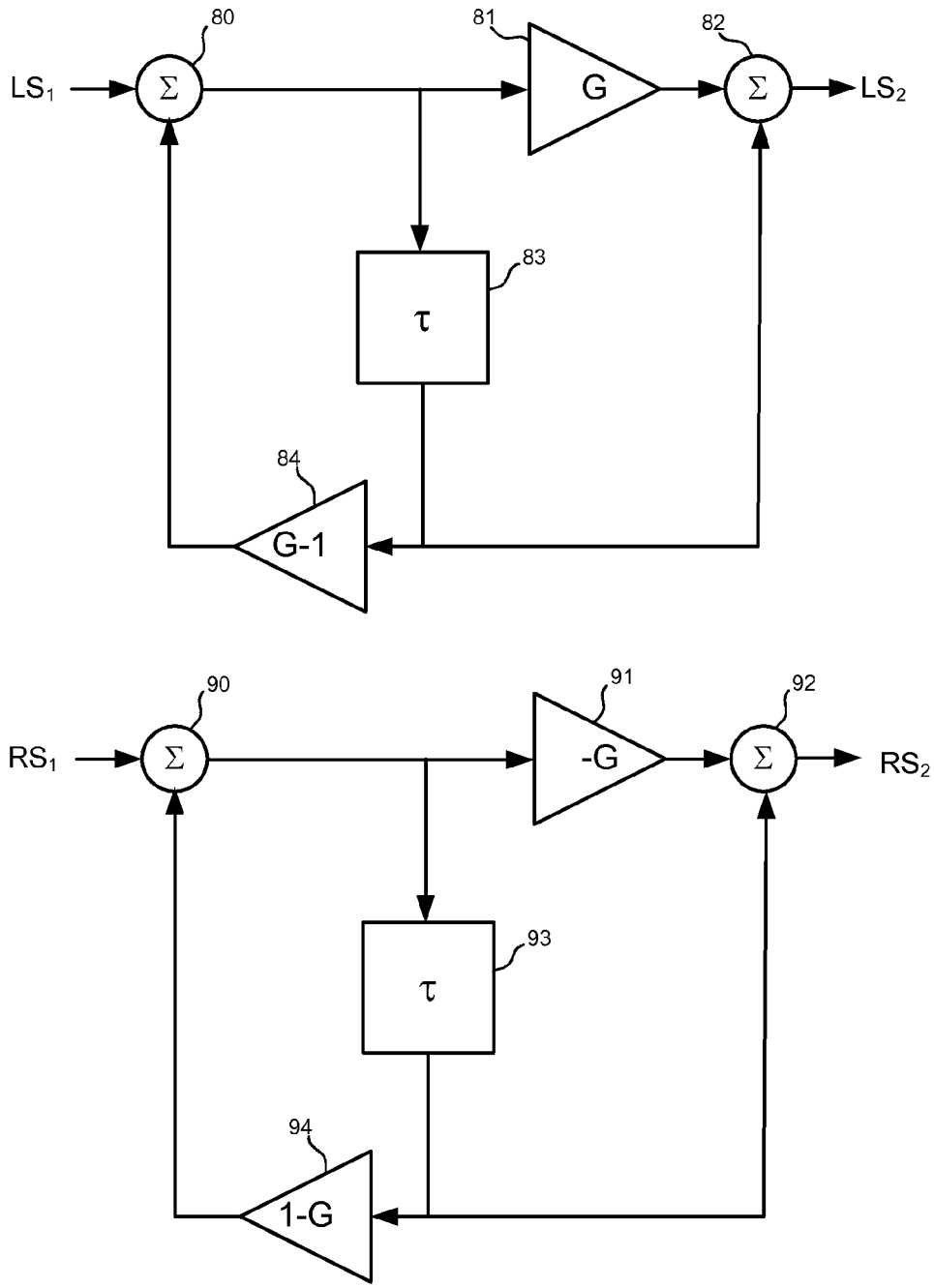
Figure 5 – Decorrelation Filters

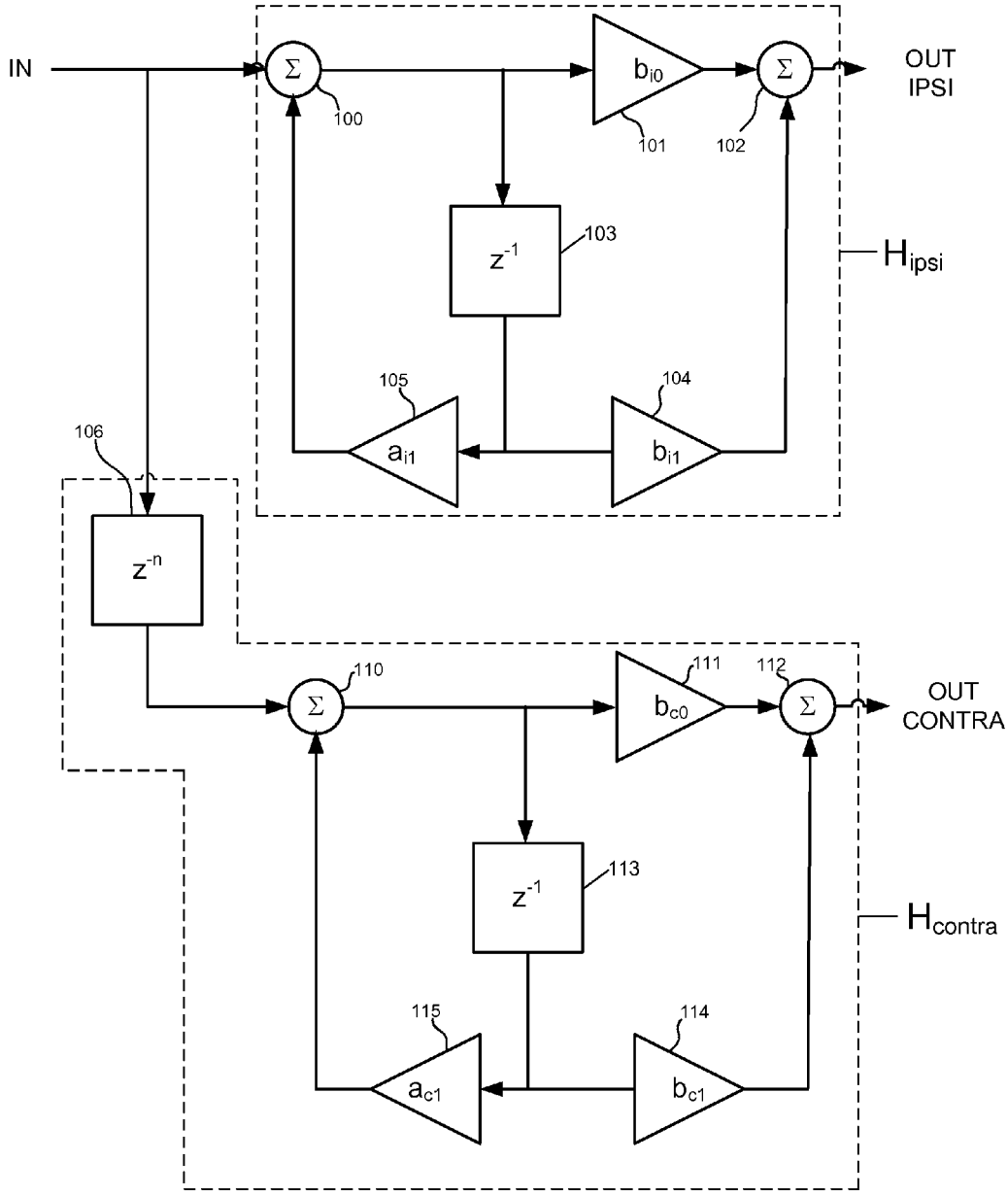
Figure 6 – HRTF Model for two ears

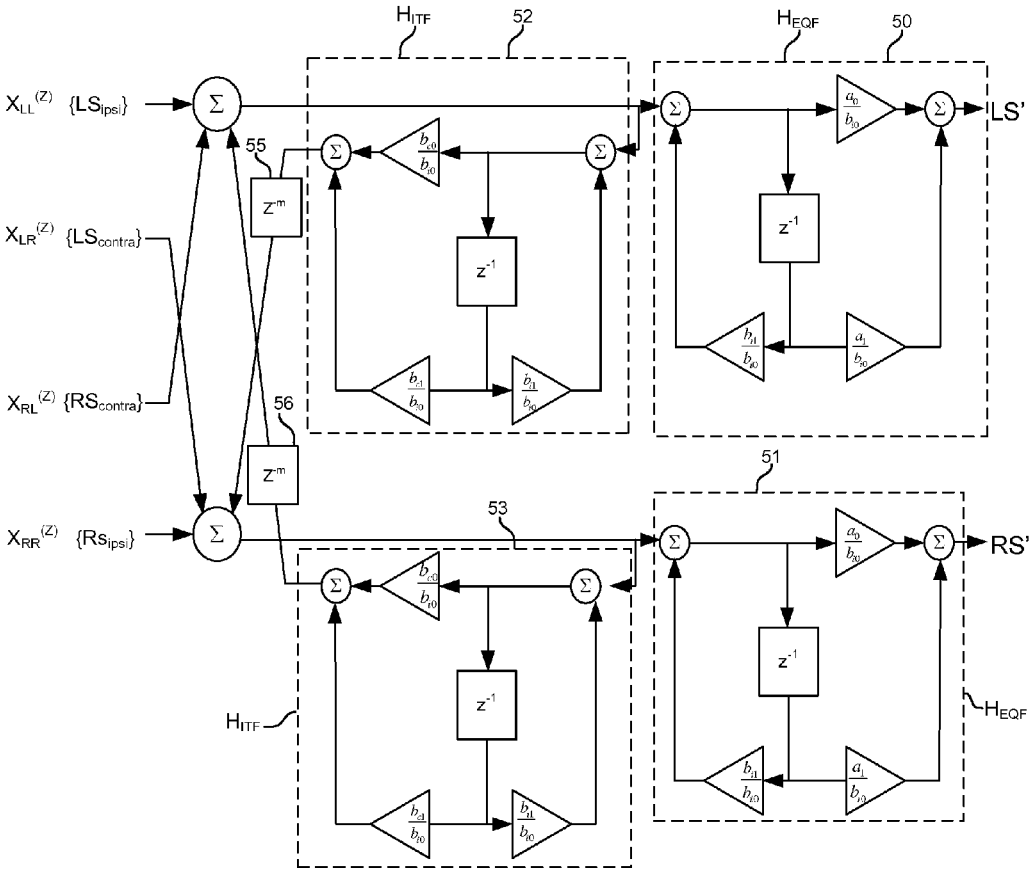
Figure 7 – Crosstalk Canceller
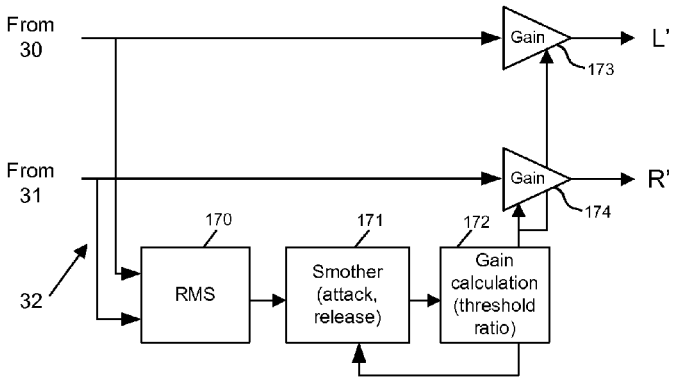
Figure 8 – Limiter

SURROUND SOUND VIRTUALIZER AND METHOD WITH DYNAMIC RANGE COMPRESSION

CROSS-REFERENCE TO RELATED APPLICATIONS

This application claims priority to U.S. Provisional Patent Appln. No. 61/122,647 filed Dec. 15, 2008, hereby incorporated by reference in its entirety.

FIELD OF THE INVENTION

The invention relates to surround sound virtualizer systems and methods for generating output signals for reproduction by a pair of physical speakers (headphones or loudspeakers) positioned at output locations, in response to at least two input audio signals indicative of sound from multiple source locations including at least two rear locations. Typically, the output signals are generated in response to a set of five input signals indicative of sound from three front locations (left, center, and right front sources) and two rear locations (left-surround and right-surround rear sources).

BACKGROUND OF THE INVENTION

Throughout this disclosure including in the claims, the term "virtualizer" (or "virtualizer system") denotes a system coupled and configured to receive N input audio signals (indicative of sound from a set of source locations) and to generate M output audio signals for reproduction by a set of M physical speakers (e.g., headphones or loudspeakers) positioned at output locations different from the source locations, where each of N and M is a number greater than one. N can be equal to or different than M. A virtualizer generates (or attempts to generate) the output audio signals so that when reproduced, the listener perceives the reproduced signals as being emitted from the source locations rather than the output locations of the physical speakers (the source locations and output locations are relative to the listener). For example, in the case that M=2 and N>3, a virtualizer downmixes the N input signals for stereo playback. In another example in which N=M=2, the input signals are indicative of sound from two rear source locations (behind the listener's head), and a virtualizer generates two output audio signals for reproduction by stereo loudspeakers positioned in front of the listener such that the listener perceives the reproduced signals as emitting from the source locations (behind the listener's head) rather than from the loudspeaker locations (in front of the listener's head).

Throughout this disclosure including in the claims, the expression "rear" location (e.g., "rear source location") denotes a location behind a listener's head, and the expression "front" location" (e.g., "front output location") denotes a location in front of a listener's head. Similarly, "front" speakers denotes speakers located in front of a listener's head and "rear" speakers denotes speakers located behind a listener's head.

Throughout this disclosure including in the claims, the expression "system" is used in a broad sense to denote a device, system, or subsystem. For example, a subsystem that implements a virtualizer may be referred to as a virtualizer system, and a system including such a subsystem (e.g., a system that generates M output signals in response to X+Y inputs, in which the subsystem generates X of the inputs and the other Y inputs are received from an external source) may also be referred to as a virtualizer system.

Throughout this disclosure including in the claims, the expression "reproduction" of signals by speakers denotes causing the speakers to produce sound in response to the signals, including by performing any required amplification and/or other processing of the signals.

Virtual surround sound can help create the perception that there are more sources of sound than there are physical speakers (e.g., headphones or loudspeakers). Typically, at least two speakers are required for a normal listener to perceive reproduced sound as if it is emitting from multiple sound sources.

For example, consider a simple surround sound virtualizer coupled and configured to receive input audio from three sources (left, center and right) and to generate output audio for two physical loudspeakers (positioned symmetrically in front of a listener) in response to the input audio. Such a virtualizer asserts input from the left source to the left speaker, asserts input from the right source to the right speaker, and splits input from the center source equally between the left and right speakers. The output of the virtualizer that is indicative of the input from the center source is commonly referred to as a "phantom" center channel. A listener perceives the reproduced output audio as if it includes a center channel emitting from a center speaker between the left and right speakers, as well as left and right channels emitting from the left and right speakers.

Another conventional surround sound virtualizer (shown in FIG. 1) is known as a "LoRo" or left-only, right-only downmix virtualizer. This virtualizer is coupled to receive five input audio signals: left ("L"), center ("C") and right ("R") front channels, and left-surround ("LS") and right-surround ("RS") rear channels. The FIG. 1 virtualizer combines the input signals as indicated, for reproduction on left and right physical loudspeakers (to be positioned in front of the listener): the input center signal C is amplified in amplifier G, and the amplified output of amplifier G is summed with the input L and LS signals to generate the left output ("Lo") asserted to the left speaker and is summed with the input R and RS signals to generate the right output ("Ro") asserted to the right speaker.

Another conventional surround sound virtualizer is shown in FIG. 2. This virtualizer is coupled to receive five input audio signals (left ("L"), center ("C"), and right ("R") front channels representing L, C, and R front sources, and left-surround ("LS") and right-surround ("RS") rear channels representing LS and RS rear sources) and configured to generate a phantom center channel by splitting input from center channel C equally between left and right signals for driving a pair of physical front loudspeakers (positioned in front of a listener). The virtualizer of FIG. 2 is also configured to use virtualizer subsystem 10 in an effort to generate left and right outputs LS' and RS' useful for driving the front loudspeakers to emit sound that the listener perceives as reproduced input rear (surround) sound emitting from RS and LS sources behind the listener. More specifically, virtualizer subsystem 10 is configured to generate output audio signals LS' and RS' in response to rear channel inputs (LS and RS) including by transforming the inputs in accordance with a head-related transfer function (HRTF). By implementing an appropriate HRTF, virtualizer subsystem 10 can generate a pair of output signals that can be reproduced by two physical loudspeakers located in front of a listener so that the listener perceives the output of the loudspeakers as being emitted from a pair of sources positioned at any of a wide variety of positions (e.g., positions behind the listener's head). The FIG. 2 virtualizer also amplifies the input center signal C in amplifier G, and the amplified output of amplifier G is summed with the input L signal and LS' output of subsystem 10 to generate the left output ("L'") for assertion to the left speaker, and is summed with the input R signal and RS' output of subsystem 10 to generate the right output ("R'") for assertion to the right speaker.

It is conventional for virtual surround systems to use head-related transfer functions (HRTFs) to generate audio signals that, when reproduced by a pair of physical speakers positioned in front of a listener are perceived at the listener's eardrums as sound from loudspeakers at any of a wide variety of positions (including positions behind the listener). A disadvantage of conventional use of one standard HRTF (or a set of standard HRTFs) to generate audio signals for use by many listeners (e.g., the general public) is that an accurate HRTF for each specific listener should depend on characteristics of the listener's head. Thus, HRTFs should vary greatly among listeners and a single HRTF will generally not be suitable for all or many listeners.

If two physical loudspeakers (as opposed to headphones) are used to present a virtualizer's audio output, an effort must be made to isolate the sound from the left loudspeaker to the left ear, and from the right loudspeaker to the right ear. It is conventional to use a cross-talk canceller to achieve this isolation. In order to implement cross-talk cancellation, it is conventional for a virtualizer to implement a pair of HRTFs (for each sound source) to generate outputs that, when reproduced, are perceived as emitting from the source location. A disadvantage of traditional cross-talk cancellation is that the listener must remain in a fixed "sweet spot" location to obtain the benefits of the cancellation. Usually, the sweet spot is a position at which the loudspeakers are at symmetric locations with respect to the listener, although asymmetric positions are also possible.

Virtualizers can be implemented in a wide variety of multimedia devices that contain stereo loudspeakers (televisions, PCs, iPod docks), or are intended for use with stereo loudspeakers or headphones.

There is a need for a virtualizer with low processor speed (e.g., low MIPS) requirements and low memory requirements, and with improved sonic performance. Typical embodiments of the present invention achieve improved sonic performance with reduced computational requirements by using a novel, simplified filter topology.

There is also a need for a surround sound virtualizer which emphasizes virtualized sources (e.g., virtualized surround-sound rear channels) in the mix determined by the virtualizer's output when appropriate (e.g., when the virtualized sources are generated in response to low-level rear source inputs), while avoiding excessive emphasis of the virtual channels (e.g., avoiding virtual rear speakers being perceived as overly loud). Embodiments of the present invention apply dynamic range compression during generation of virtualized surround-sound channels (e.g., virtualized rear channels) to achieve such improved sonic performance during reproduction of the virtualizer output. Typical embodiments of the present invention also apply decorrelation and cross-talk cancellation for the virtualized sources to provide improved sonic performance (including improved localization) during reproduction of the virtualizer output.

BRIEF DESCRIPTION OF THE INVENTION

In some embodiments, the invention is a surround sound virtualization method and system for generating output signals for reproduction by a pair of physical speakers (e.g., headphones or loudspeakers positioned at output locations) in response to a set of N input audio signals (where N is a number not less than two), where the input audio signals are indicative of sound from multiple source locations including at least two rear locations. Typically, N=5 and the input signals are indicative of sound from three front locations (left, center, and right front sources) and two rear locations (left-surround and right-surround rear sources).

In typical embodiments, the inventive virtualizer generates left and right output signals (L' and R') for driving a pair of front loudspeakers in response to five input audio signals: a left ("L") channel indicative of sound from a left front source, a center ("C") channel indicative of sound from a center front source, a right ("R") channel indicative of sound from a right front source, a left-surround ("LS") channel indicative of sound from a left rear source, and a right-surround ("RS") channel indicative of sound from a right front source. The virtualizer generates a phantom center channel by splitting the center channel input between the left and right output signals. The virtualizer includes a rear channel (surround) virtualizer subsystem configured to generate left and right surround outputs (LS' and RS') useful for driving the front loudspeakers to emit sound that the listener perceives as emitting from RS and LS sources behind the listener. The surround virtualizer subsystem is configured to generate the LS' and RS' outputs in response to the rear channel inputs (LS and RS) by transforming the rear channel inputs in accordance with a head-related transfer function (HRTF). The virtualizer combines the LS' and RS' outputs with the L, C, and R front channel inputs to generate the left and right output signals (L' and R'). When the L' and R' outputs are reproduced by the front loudspeakers, the listener perceives the resulting sound as emitting from RS and LS rear sources as well as from L, C, and R front sources.

In a class of embodiments, the inventive method and system implements a HRTF model that is simple to implement and customizable to any source location and physical speaker location relative to each ear of the listener. Preferably, the HRTF model is used to calculate a generalized HRTF employed to generate left and right surround outputs (LS' and RS') in response to rear channel inputs (LS and RS), and also to calculate HRTFs that are employed to perform cross-talk cancellation on the left and right surround outputs (LS' and RS') for a given set of physical speaker locations.

To ensure that the virtual channels (e.g., left-surround and right-surround virtual rear channels) are well heard in the presence of other channels by one listening to the reproduced virtualizer output, the virtualizer performs dynamic range compression on the rear source inputs (during generation in response to rear source inputs of surround signals useful for driving front loudspeakers to emit sound that a listener perceives as emitting from rear source locations) to help normalize the perceived loudness of the virtual rear channels.

Herein, performing dynamic range compression "on" inputs (during generation of surround signals) is used in a broad sense to denote performing dynamic range compression directly on the inputs or on processed versions of the inputs (e.g., on versions of the inputs that have undergone decorrelation or other filtering). Further processing on the signals that have undergone dynamic range compression may be required to generate the surround signals, or the surround signals may be the output of the dynamic range compression means. More generally, the expression performing an operation (e.g., filtering, decorrelating, or transforming in accordance with an HRTF) "on" inputs (during generation of surround signals inputs) is used herein, including in the claims, in a broad sense to denote performing the operation directly on the inputs or on processed versions of the inputs.

The dynamic range compression is preferably accomplished by nonlinear amplification of the rear source (surround) inputs or partially processed versions thereof (e.g., amplification of the rear source inputs in a nonlinear way relative to front channel signals). Preferably, in response to input surround signals (indicative of sound from left-surround and right-surround rear sources) that are below a predetermined threshold and in response to input front signals, the input surround signals are amplified relative to the front signals (more gain is applied to the surround signals than to the front signals) before they undergo decorrelation and transformation in accordance with a head-related transfer function. Preferably, the input surround signals (or partially processed versions thereof) are amplified in a nonlinear manner depending on the amount by which the input surround signals are below the threshold. When the input surround signals are above the threshold, they are typically not amplified (optionally, the input front signals and input surround signals are amplified by the same amount when the input surround signals are above the threshold, e.g., by an amount depending on a predetermined compression ratio). Dynamic range compression in accordance with the invention can result in amplification of the input rear channels by a few decibels relative to the front channels to help bring the virtual rear channels out in the mix when this is desirable (i.e., when the input rear channel signals are below the threshold) without excessive amplification of the virtual rear channels when the input rear channel signals are above the threshold (to avoid the virtual rear speakers being perceived as overly loud).

In a class of embodiments, the inventive method and system implements decorrelation of virtualized sources to provide improved localization while avoiding problems due to physical speaker symmetry when presenting virtual speakers. Without such decorrelation, if the physical speakers (e.g., loudspeakers in front of the listener) are symmetrical with respect to the listener (e.g., when the listener is in a sweet spot), the perceived virtual speakers' locations are also symmetrical with respect to the listener. In this case, if both virtual rear channels (indicative of left-surround and right-surround rear source inputs) are identical then the reproduced signals at both ears are also identical and the rear sources are no longer virtualized (the listener does not perceive the reproduced sound as emitting from behind the listener). Also, without decorrelation and with symmetrical physical speaker placement in front of the listener, reproduced output of a virtualizer in response to panned rear source input (input indicative of sound panned from a left-surround rear source to a right-surround rear source) will seem to come from directly ahead during the middle of the pan. The noted class of embodiments avoids these problems (commonly referred to as "image collapse") by implementing decorrelation of rear source (surround) input signals. Decorrelating the rear source inputs when they are identical to each other eliminates the commonality between them and avoids image collapse.

In typical embodiments, the inventive system is or includes a general or special purpose processor programmed with software (or firmware) and/or otherwise configured to perform an embodiment of the inventive method. In some embodiments, the inventive virtualizer system is a general purpose processor, coupled to receive input data indicative of multiple audio input channels and programmed (with appropriate software) to generate output data indicative of output signals (for reproduction by a pair of physical speakers) in response to the input data by performing an embodiment of the inventive method. In other embodiments, the inventive virtualizer system is implemented by appropriately configuring (e.g., by programming) a configurable audio digital signal processor (DSP). The audio DSP can be a conventional audio DSP that is configurable (e.g., programmable by appropriate software or firmware, or otherwise configurable in response to control data) to perform any of a variety of operations on input audio. In operation, an audio DSP that has been configured to perform surround sound virtualization in accordance with the invention is coupled to receive multiple audio input signals (indicative of sound from multiple source locations including at least two rear locations), and the DSP typically performs a variety of operations on the input audio in addition to (as well as) virtualization. In accordance with various embodiments of the invention, an audio DSP is operable to perform an embodiment of the inventive method after being configured (e.g., programmed) to generate output audio signals (for reproduction by a pair of physical speakers) in response to the input audio signals by performing the method on the input audio signals.

In some embodiments, the invention is a sound virtualization method for generating output signals for reproduction by a pair of physical speakers at physical locations relative to a listener, where none of the physical locations is a location in a set of at least two rear source locations, said method including the steps of:

(a) in response to input audio signals indicative of sound from the rear source locations, generating surround signals useful for driving the speakers at the physical locations to emit sound that the listener perceives as emitting from said rear source locations, including by performing dynamic range compression on the input audio signals; and (b) generating the output signals in response to the surround signals and at least one other input audio signal, where each said other input audio signal is indicative of sound from a respective front source location, such that the output signals are useful for driving the speakers at the physical locations to emit sound that the listener perceives as emitting from the rear source locations and from each said front source location.

Typically, the physical speakers are front loudspeakers, the physical locations are in front of the listener, and step (a) includes the step of generating left and right surround signals (LS' and RS') in response to left and right rear input signals (LS and RS), where the left and right surround signals (LS' and RS") are useful for driving the front loudspeakers to emit sound that the listener perceives as emitting from left rear and right rear sources behind the listener. The physical speakers alternatively could be headphones, or loudspeakers positioned other than at the rear source locations (e.g., loudspeakers positioned to the left and right of the listener). Preferably, the physical speakers are front loudspeakers, the physical locations are in front of the listener, step (a) includes the step of generating left and right surround signals (LS' and RS') useful for driving the front loudspeakers to emit sound that the listener perceives as emitting from left rear and right rear sources behind the listener, and step (b) includes the step of generating the output signals in response to: the surround signals, a left input audio signal indicative of sound from a left front source location, a right input audio signal indicative of sound from a right front source location, and a center input audio signal indicative of sound from a center front source location. Preferably, step (b) includes a step of generating a phantom center channel in response to the center input audio signal.

Preferably, the dynamic range compression helps to normalize the perceived loudness of the virtual rear channels. Also preferably, the dynamic range compression is performed by amplifying the input audio signals in a nonlinear way relative to each said other input audio signal. Preferably, step (a) includes a step of performing the dynamic range compression including by amplifying each of the input audio signals having a level (e.g., an average level over a time window)

below a predetermined threshold in a nonlinear manner depending on the amount by which the level is below the threshold.

Preferably, step (a) includes a step of generating the surround signals including by transforming the input audio signals in accordance with a head-related transfer function (HRTF), and/or performing decorrelation on the input audio signals, and/or performing cross-talk cancellation on the input audio signals. Herein, the expression "performing" an operation (e.g., transformation in accordance with an HRTF, or dynamic range compression, or decorrelation) "on" input audio signals is used in a broad sense to denote performing the operation on the input audio signals or on processed versions of the input audio signals (e.g., on versions of the input audio signals that have undergone decorrelation or other filtering).

Aspects of the invention include a virtualizer system configured (e.g., programmed) to perform any embodiment of the inventive method, and a computer readable medium (e.g., a disc) which stores code for implementing any embodiment of the inventive method.

BRIEF DESCRIPTION OF THE DRAWINGS

FIG. 1 is a block diagram of a conventional surround sound virtualizer system.

FIG. 2 is a block diagram of another conventional surround sound virtualizer system.

FIG. 3 is a block diagram of an embodiment of the inventive surround sound virtualizer system.

FIG. 4 is a block diagram of an implementation of stage 41 of virtualizer subsystem 40 of FIG. 3.

FIG. 5 is a block diagram of an implementation of stage 42 of virtualizer subsystem 40 of FIG. 3.

FIG. 6 is a block diagram of an implementation of one HRTF circuit of stage 43 of virtualizer subsystem 40.

FIG. 7 is a block diagram of an implementation of stage 44 of virtualizer subsystem 40.

FIG. 8 is a detailed block diagram of an implementation of limiter 32 of the virtualizer system of FIG. 3.

FIG. 9 is a block diagram of an audio digital signal processor (DSP) that is an embodiment of the inventive surround sound virtualizer system.

DETAILED DESCRIPTION OF THE PREFERRED EMBODIMENTS

Many embodiments of the present invention are technologically possible. It will be apparent to those of ordinary skill in the art from the present disclosure how to implement them. Embodiments of the inventive system, method, and medium will be described with reference to FIGS. 3-9.

In some embodiments, the invention is a sound virtualization method for generating output signals (e.g., signals L' and R' of FIG. 3) for reproduction by a pair of physical speakers at physical locations relative to a listener, where none of the physical locations is a location in a set of at least two rear source locations, said method including the steps of:

(a) in response to input audio signals (e.g., left and right rear input signals, LS and RS, of FIG. 3) indicative of sound from the rear source locations, generating surround signals (e.g., surround signals LS' and RS' of FIG. 3) useful for driving the speakers at the physical locations to emit sound that the listener perceives as emitting from said rear source locations, including by performing dynamic range compression on the input audio signals; and (b) generating the output signals in response to the surround signals (e.g., surround signals LS' and RS' of FIG. 3) and at least one other input audio signal (e.g., input signals C, L, and R, of FIG. 3), where each said other input audio signal is indicative of sound from a respective front source location, such that the output signals are useful for driving the speakers at the physical locations to emit sound that the listener perceives as emitting from the rear source locations and from each said front source location.

Typically, the physical speakers are front loudspeakers, the physical locations are in front of the listener, and step (a) includes the step of generating left and right surround signals (e.g., signals LS' and RS' of FIG. 3) in response to left and right rear input signals (e.g., signals LS and RS of FIG. 3), where the left and right surround signals are useful for driving the front loudspeakers to emit sound that the listener perceives as emitting from left rear and right rear sources behind the listener. The physical speakers alternatively could be headphones, or loudspeakers positioned other than at the rear source locations (e.g., loudspeakers positioned to the left and right of the listener). Preferably, the physical speakers are front loudspeakers, the physical locations are in front of the listener, step (a) includes the step of generating left and right surround signals (e.g., signals LS' and RS' of FIG. 3) useful for driving the front loudspeakers to emit sound that the listener perceives as emitting from left rear and right rear sources behind the listener, and step (b) includes the step of generating the output signals in response to: the surround signals, a left input audio signal indicative of sound from a left front source location, a right input audio signal indicative of sound from a right front source location, and a center input audio signal indicative of sound from a center front source location. Preferably, step (b) includes a step of generating a phantom center channel in response to the center input audio signal.

In some embodiments, the invention is a surround sound virtualization method and system for generating output signals for reproduction by a pair of physical speakers (e.g., headphones or loudspeakers positioned at output locations) in response to a set of N input audio signals (where N is a number not less than two), where the input audio signals are indicative of sound from multiple source locations including at least two rear locations. Typically, N=5 and the input signals are indicative of sound from three front locations (left, center, and right front sources) and two rear locations (left-surround and right-surround rear sources).

FIG. 3 is a block diagram of an embodiment of the inventive virtualizer system. The virtualizer of FIG. 3 is configured to generate left and right output signals (L' and R') for driving a pair of front loudspeakers (or other speakers) in response to five input audio signals: a left ("L") channel indicative of sound from a left front source, a center ("C") channel indicative of sound from a center front source, a right ("R") channel indicative of sound from a right front source, a left-surround ("LS") channel indicative of sound from a left rear source LS, and a right-surround ("RS") channel indicative of sound from a right front source RS. The virtualizer generates a phantom center channel (and combines it with left and right front channels L and R and virtual left and virtual right rear channels) by amplifying the center input C in amplifier G, summing the amplified output of amplifier G with input L and left surround output signal LS' (to be described below) in summation element 30 to generate an unlimited left output, and summing the amplified output of amplifier G with input R and right surround output signal RS' (to be described below) in summation element 31 to generate an unlimited right output.

The unlimited left and right outputs are processed by limiter 32 to avoid saturation. In response to the unlimited left output, limiter 32 generates the left output (L') that is asserted to the left front speaker. In response to the unlimited right output, limiter 32 generates the right output (R') that is asserted to the right front speaker. When the L' and R' outputs are reproduced by the front loudspeakers, the listener perceives the resulting sound as emitting from RS and LS rear sources as well as from L, C, and R front sources.

Rear channel (surround) virtualizer subsystem 40 of the system of FIG. 3 generates left and right surround output signals LS' and RS' useful for driving front speakers to emit sound that the listener perceives as emitting from the right rear source RS and left rear source LS behind the listener. Virtualizer subsystem 40 includes dynamic range compression stage 41, decorrelation stage 42, binaural model stage (HRTF stage) 43, and cross-talk cancellation stage 44 connected as shown. Virtualizer subsystem 40 generates the LS' and RS' output signals in response to rear channel inputs (LS and RS) by performing dynamic range compression on the inputs LS and RS in stage 41, decorrelating the output of stage 41 in stage 42, transforming the output of stage 42 in accordance with a head-related transfer function (HRTF) in stage 43, and performing cross-talk cancellation on the output of stage 43 in stage 44 which outputs the signals LS' and RS'.

In embodiments of the invention in which the physical speakers are implemented as headphones, cross-talk cancellation is typically not required. Such embodiments can be implemented by variations on the system of FIG. 3 in which stage 44 is omitted.

HRTF stage 43 applies an HRTF comprising two transfer functions $HRTF_{ipsi}(t)$ and $HRTF_{contra}(t)$ to the output of stage 42 as follows. In response to decorrelated left rear input L(t) from stage 42 (identified as "$LS_2$" in FIG. 5), stage 43 generates audio signals $x_{LL}(t)$ and $x_{LR}(t)$ by applying the transfer functions as follows: $HRTF_{ipsi}(t)L(t)=x_{LL}(t)$, where $x_{LL}(t)$ is the sound heard at (incident at) the listener's left ear in response to input L(t), and $HRTF_{contra}(t)L(t)=x_{LR}(t)$, where $x_{LR}(t)$ is the sound heard at (incident at) the listener's right ear in response to input L(t). Similarly, in response to decorrelated right rear input R(t) from stage 42 (identified as "$RS_2$" in FIG. 5), stage 43 generates audio signals $x_{RL}(t)$ and $x_{RR}(t)$ by applying the transfer functions as follows: $HRTF_{ipsi}(t)R(t)=x_{RL}(t)$, where $x_{RL}(t)$ is the sound heard at the listener's left ear in response to input R(t), and $HRTF_{contra}(t)R(t)=x_{RR}(t)$, where $x_{RR}(t)$ is the sound heard at the listener's right ear in response to input R(t). Thus, $HRTF_{ipsi}(t)$ is an ipsilateral filter for the ear nearest the speaker (which in stage 43 is a virtual speaker), and $HRTF_{contra}(t)$ is a contralateral filter for the ear farthest from the speaker (which in stage 43 is also a virtual speaker). Stage 43 applies $HRTF_{ipsi}$ to L(t) to generate sound to be emitted from the left front speaker and perceived as audio L(t) from a virtual left rear speaker at the left ear, and applies $HRTF_{contra}$ to L(t) to generate sound to be emitted from the right front speaker and perceived as audio L(t) from the virtual left rear speaker at the right ear. Stage 43 applies $HRTF_{ipsi}$ to R(t) to generate sound to be emitted from the right front speaker and perceived as R(t) from a virtual right rear speaker at the right ear, and applies $HRTF_{contra}$ to R(t) to generate sound to be emitted from the left front speaker and perceived as R(t) from the virtual right rear speaker at the left ear.

Preferably, HRTF stage 43 implements an HRTF model that is simple to implement and customizable to any source location (and optionally also any physical speaker location) relative to each ear of the listener. For example, stage 43 may implement an HRTF model of the type described in Brown, P. and Duda, R., "A Structural Model for Binaural Sound Synthesis," IEEE Transactions on Speech and Audio Processing, September 1998, Vol. 6, No. 5, pp. 476-488. Although this model lacks some subtle features of an actually measured HRTF, it has several important advantages including that it is simple to implement, and customizable to any location and thus more universal than a measured HRTF. In typical implementations, the same HRTF model employed to calculate the generalized transfer functions $HRTF_{ipsi}$ and $HRTF_{contra}$ applied by stage 43 is also employed to calculate the transfer functions $HRTF_{ITF}$ and $HRTF_{EQF}$ (to be described below) applied by stage 44 to perform cross-talk cancellation on the outputs of stage 43 for a given set of physical speaker locations. The HRTF applied by stage 43 assumes specific angles of the virtual rear loudspeakers; the HRTFs applied by stage 44 assume specific angles of the physical front loudspeakers relative to the listener.

Stage 41 implements dynamic range compression to ensure that the virtual left-surround and right-surround rear channels are well heard in the presence of the other channels by one listening to the reproduced output of the FIG. 3 virtualizer. Stage 41 helps to bring out low level virtual channels that would normally be masked by the other channels, so that the rear surround sound content is heard more frequently and more reliably than without dynamic range compression. Stage 41 helps to normalize perceived loudness of the virtual rear channels by amplifying rear source (surround) inputs LS and RS in a nonlinear way relative to front channel input signals L, R, and C. More specifically, in response to determining that input surround signal LS is below a predetermined threshold, input signal LS is amplified (nonlinearly) relative to the front channel input signals (more gain is applied to signal LS than to the front channel input signals), and in response to determining that input RS is below the predetermined threshold, input RS is amplified (nonlinearly) relative to the front channel input signals (more gain is applied to signal RS than to the front channel input signals). Preferably, input signals LS and RS below the threshold are amplified in a nonlinear manner depending on the amount (if any) by which each is below the threshold. The output of stage 41 then undergoes decorrelation in stage 42.

When either one of input signals LS and RS is above the threshold, it is not amplified by more than are the input front signals. Rather, stage 41 amplifies each of signals LS and RS that is above the threshold by an amount depending on a predetermined compression ratio which is typically the same compression ratio in accordance with which the input front signals are amplified (by amplifier G and other amplification means not shown). Where the compression ratio is N:1, the amplified signal level in dB is N·I, where I is the input signal level in dB. A wideband implementation of stage 41 (for amplifying all, or a wide range, of the frequency components of inputs LS and RS) is typical, but multi-band implementations (for amplifying only frequency components of the inputs in specific frequency bands, or amplifying frequency components of the inputs in different frequency bands differently) could alternatively be employed. The compression ratio and threshold are set in a manner that will be apparent to those of ordinary skill in the art, such that stage 41 makes typical, low-level surround sound content clearly audible (in the mix determined by the FIG. 3 virtualizer's output).

FIG. 4 is a block diagram of a typical implementation of stage 41, comprising RMS power determination element 70, smoothness determination element 71, gain calculation element 72, and amplification elements 73 and 74, connected as shown. In this implementation, the average level (RMS power averaged over a time interval, i.e., over a predetermined time window) of each input LS and RS is determined in element 70, and the smoothness of stage 41's response (the quickness with which gain calculation element 72 changes the gain to be applied by amplifiers 73 and 74 to each input in response to each increase and decrease in each input's average level) is determined by element 71 in response to the average levels of the input signals and the gain to be applied to each input. A typical attack time (a time constant for response to an input level increase) is 1 ms, and a typical release time (a time constant for response to an input level decrease) is 250 ms. Gain calculation element 72 determines the amount of gain to be applied by amplifier 73 to input LS (to generate the amplified output $LS_1$) depending on the amount by which the current average level of LS is above or below the threshold (and the current attack and release times) and the amount of gain to be applied by amplifier 74 to input RS (to generate the amplified output $RS_1$) depending on the amount by which the current average level of RS is above or below the threshold (and the current attack and release times). A typical threshold is 50% of full scale, and a typical compression ratio is 2:1 for amplification of each input when its level is above the threshold.

In typical implementations, dynamic range compression in stage 41 amplifies the rear input channels by a few decibels relative to the front input channels to help emphasize the virtual rear channels in the mix when their levels are sufficiently low to make such emphasis desirable (i.e., when the rear input signals are below the predetermined threshold) while avoiding excessive amplification of the virtual rear channels when the input rear channel signals are above the threshold (to avoid the virtual rear speakers being perceived as overly loud).

Stage 42 decorrelates the left and right outputs of stage 41 to provide improved localization and avoid problems that could otherwise occur due to symmetry (with respect to the listener) of the physical speakers that present the virtual channels determined by the FIG. 3 virtualizer's output. Without such decorrelation, if physical loudspeakers (in front of the listener) are positioned symmetrically with respect to the listener, the perceived virtual speaker locations are also symmetrical with respect to the listener. With such symmetry and without decorrelation, if both virtual rear channels (indicative of rear inputs LS and RS) are identical, the reproduced signals at both ears are also identical and the rear sources are no longer virtualized (the listener does not perceive the reproduced sound as emitting from behind the listener). Also with such symmetry and without decorrelation, reproduced output of a virtualizer in response to panned rear source input (input indicative of sound panned from a left-surround rear source to a right-surround rear source) will seem to come from directly ahead (between the physical front speakers) during the middle of the pan. Stage 42 avoids these problems (commonly referred to as "image collapse") by decorrelating the left and right outputs of stage 41 when they are identical to each other, to eliminate the commonality between them and thereby avoid image collapse.

In decorrelation stage 42, complementary decorrelators are employed to decorrelate the two outputs of stage 41 (one decorrelator for each of signals $LS_1$ and $RS_1$ from stage 41). Each decorrelator is preferably implemented as a Schroeder all-pass reverberator of the type described in Schroeder, M. R., "Natural Sounding Artificial Reverberation," Journal of the Audio Engineering Society, July 1962, vol. 10, No. 3, pp. 219-223. When only one input channel is active, stage 42 introduces no noticeable timbre shift to its input. When both input channels are active, and the source to each channel is identical, stage 42 does introduce a timbre shift but the effect is that the stereo image is now wide, rather than center panned.

FIG. 5 is a block diagram of a typical implementation of stage 42 as a pair of Schroeder all-pass reverberators. One reverberator of the FIG. 5 implementation of stage 42 is a feedback loop including input summation element 80 having an input coupled to receive left input signal $LS_1$ from stage 41, and whose output is asserted to delay element 83 which applies delay $\tau$ thereto, and to an amplifier 81 which applies gain G thereto. The output of this amplifier is asserted to output summation element 82 (to which the output of delay element 83 is also asserted) which outputs left signal $LS_2$. The output of delay element 83 is asserted to another amplifier 84 which applies gain G−1 thereto, and the output of amplifier 84 is asserted to the second input of input summation element 80. The other reverberator of the FIG. 5 implementation of stage 42 is a feedback loop including input summation element 90 having an input coupled to receive right input signal $RS_1$ from stage 41, and whose output is asserted to delay element 93 which applies delay $\tau$ thereto, and to amplifier 91 which applies gain −G thereto. The output of amplifier 91 is asserted to output summation element 92 (to which the output of delay element 93 is also asserted) which outputs right signal $RS_2$ (signal $RS_2$ is decorrelated from signal $LS_2$). The output of delay element 93 is asserted to another amplifier 94 which applies gain 1−G thereto, and the output of amplifier 94 is asserted to the second input of input summation element 90. A typical value of the gain parameter is G=0.5 and a typical value of the delay time $\tau$ is 2 msec.

In other implementations, stage 42 is a decorrelator of a type other than that described with reference to FIG. 5.

In a typical implementation, binaural model stage 43 includes two HRTF circuits of the type shown in FIG. 6: one coupled to filter left signal $LS_2$ from stage 42; the other to filter right signal $RS_2$ from stage 42. As is apparent from FIG. 6, each HRTF circuit implements two transfer functions $HRTF_{ipsi}(z)$ and $HRTF_{contra}(z)$, to the output of stage 42 as follows (where "z" is a discrete-time domain value of the signal being filtered). Each of transfer functions $HRTF_{ipsi}(z)$ and $HRTF_{contra}(z)$ implements a simple one pole, one zero spherical head model of a type described in the above-cited Brown, et al. paper, "A Structural Model for Binaural Sound Synthesis," IEEE Transactions on Speech and Audio Processing, September 1998.

More specifically, each HRTF circuit of stage 43 (implemented as in FIG. 6) applies two transfer functions, $HRTF_{ipsi}(z)$ ("$H_{ipsi}(z)$") and $HRTF_{contra}(z)$ ("$H_{contra}(z)$"), to one of the outputs of stage 42 (labeled signal "IN" in FIG. 6) in the discrete-time domain as follows. In response to left rear input $L_2(z)$ from stage 42, one HRTF circuit generates audio signals $x_{LL}(z)$ ("OUTipsi" in FIG. 6) and $x_{LR}(z)$ ("OUTcontra" in FIG. 6) by applying the transfer functions as follows: $HRTF_{ipsi}(z)L_2(z)=x_{LL}(z)$, where $x_{LL}(z)$ is the sound heard at the listener's left ear in response to input $L_2(z)$, and $HRTF_{contra}(z)L_2(z)=x_{LR}(z)$, where $x_{LR}(z)$ is the sound heard at the listener's right ear in response to input $L_2(z)$. In response to right rear input $R_2(z)$ from stage 42, the other HRTF circuit of stage 43 (implemented as in FIG. 6) generates audio signals $x_{LR}(z)$ and $x_{RR}(z)$ by applying the transfer functions as follows: $HRTF_{contra}(z)R_2(z)=x_{LR}(z)$, where $x_{LR}(z)$ is the sound heard at the listener's left ear in response to input $R_2(z)$, and $HRTF_{ipsi}(z)R_2(z)=x_{RR}(z)$, where $x_{RR}(z)$ is the sound heard at the listener's right ear in response to input $R_2(z)$. $HRTF_{ipsi}(z)$ is an ipsilateral filter for the ear nearest the speaker (which in stage 43 is a virtual speaker), and $HRTF_{contra}(z)$ is a contralateral filter for the ear farthest from the speaker (which in stage 43 is also a virtual speaker). The virtual speakers are set at approximately ±90°. The time delays $z^{-n}$ (implemented by each delay element of FIG. 6 labeled $z^{-n}$) also correspond to 90°, as is conventional.

The HRTF circuit of stage 43 (implemented as in FIG. 6) for applying transfer function $HRTF_{ipsi}(z)$ includes delay element 103, gain elements 101, 104, and 105 (for applying below-defined gains $b_{i0}$, $b_{i1}$, and $a_{i1}$, respectively) and summation elements 100 and 102, connected as shown. The HRTF circuit of stage 43 (implemented as in FIG. 6) for applying transfer function $HRTF_{contra}(z)$ includes delay elements 106 and 113, gain elements 111, 114, and 115 (for applying below-defined gains $b_{c0}$, $b_{c1}$, and $a_{c1}$, respectively) and summation elements 110 and 112, connected as shown.

The interaural time delay (ITD) implemented by stage 43 (implemented as in FIG. 6) is the delay introduced by each delay element labeled "$z^{-n}$." The interaural time delay is derived for the horizontal plane as follows:

$$ITD=(a/c)\cdot(\arcsin(\cos\phi\cdot\sin\theta)+\cos\phi\cdot\sin\theta), \quad (1)$$

where θ=azimuth angle, ϕ=elevation angle, a is the radius of the listener's head, and c is the speed of sound. Note that the angles in equation (1) are expressed in radians (rather than degrees) for the ITD calculation. Also note that θ=0 radians (0°) is straight ahead, and θ=π/2 radians (90°) is directly to the right.

For ϕ=0 (the horizontal plane):

$$ITD=(a/c)\cdot(\theta+\sin\theta) \quad (2)$$

where θ is in the range from 0 to π/2 radians inclusive.

In the continuous-time domain, the HRTF model implemented by the FIG. 6 filter is:

$$H(s,\theta)=\frac{\alpha(\theta)s+\beta}{s+\beta} \quad (3)$$

where $\alpha(\theta)=1+\cos(\theta)$, and $$\beta=\frac{2c}{a},$$

with θ=azimuth angle, a=radius of the listener's head, and c=speed of sound, as above, and s is the continuous-time domain value of the input signal.

To convert this HRTF model to the discrete-time domain (in which z is the discrete-time domain value of the input signal), the bilinear transform is used as follows:

$$H(z)=\frac{\alpha(\theta)s+\beta}{s+\beta}\Big|_{s=2fs\left(\frac{z-1}{z+1}\right)}=\frac{2\alpha(\theta)\left(\frac{z-1}{z+1}\right)+\frac{\beta}{fs}}{2\left(\frac{z-1}{z+1}\right)+\frac{\beta}{fs}}=\frac{\left(\frac{\beta}{fs}+2\alpha(\theta)\right)+\left(\frac{\beta}{fs}-2\alpha(\theta)\right)z^{-1}}{\left(\frac{\beta}{fs}+2\right)+\left(\frac{\beta}{fs}-2\right)z^{-1}} \quad (4)$$

If the parameter beta from equation (3) is redefined as $$\beta=\frac{2c}{a\cdot fs}, \quad (5)$$

where fs is the sample rate, it follows that $$H(z)=\frac{(\beta+2\alpha(\theta))+(\beta-2\alpha(\theta))z^{-1}}{(\beta+2)+(\beta-2)z^{-1}}=\frac{b_0+b_1z^{-1}}{a_0+a_1z^{-1}}. \quad (6)$$

The filter of equation (6) is for sound incident at one ear of the listener. For two ears (near and far, relative to the source), the ipsilateral and contralateral filters of the FIG. 6 filter are determined from equation (6) as follows:

$$H_{ipsi}(z)=\frac{b_{i0}+b_{i1}z^{-1}}{a_{i0}+a_{i1}z^{-1}} \quad \text{(ipsilateral, near ear)} \quad (7)$$

$$H_{contra}(z)=\frac{b_{c0}+b_{c1}z^{-1}}{a_{c0}+a_{c1}z^{-1}} \quad \text{(contralateral, far ear)} \quad (8)$$

where $$a_o=a_{i0}=a_{co}=\beta+2, \quad (9)$$

$$a_1=a_{i1}=a_{c1}=\beta-2, \quad (10)$$

$$b_{i0}=\beta+2\alpha_i(\theta), \quad (11)$$

$$b_{i1}=\beta-2\alpha_i(\theta), \quad (12)$$

$$b_{c0}=\beta+2\alpha_c(\theta), \quad (13)$$

$$b_{c1}=\beta=2\alpha_c(\theta), \quad (14)$$

$$\alpha_i(\theta)=1+\cos(\theta-90°)=1+\sin(\theta), \text{ and} \quad (15)$$

$$\alpha_c(\theta)=1+\cos(\theta+90°)=1-\sin(\theta). \quad (16)$$

In alternative embodiments, each HRTF applied (or each of a subset of the HRTFs applied) applied in accordance with the invention is defined and applied in the frequency domain (e.g., each signal to be transformed in accordance with such HRTF undergoes time-domain to frequency-domain transformation, the HRFT is then applied to the resulting frequency components, and the transformed components then undergo a frequency-domain to time-domain transformation).

The filtered output of stage 43 undergoes crosstalk cancellation in stage 44. Crosstalk cancellation is a conventional operation. For example, implementation of crosstalk cancellation in a surround sound virtualizer is described in U.S. Pat. No. 6,449,368, assigned to Dolby Laboratories Licensing Corporation, with reference to FIG. 4A of that patent.

Crosstalk cancellation stage 44 of the FIG. 3 embodiment filters the output of stage 43 by applying two $H_{ITF}$ transfer functions (filters 52 and 53, connected as shown) and two $H_{EQF}$ transfer functions (filters 50 and 51, connected as shown) thereto. Each of transfer functions $H_{ITF}(z)$ and $H_{EQF}(z)$ implements the same one pole, one zero spherical head model described in the above-cited Brown, et al. paper ("A Structural Model for Binaural Sound Synthesis," IEEE Transactions on Speech and Audio Processing, September 1998) and implemented by transfer functions $HRTF_{ipsi}(z)$ and $HRTF_{contra}(z)$ of stage 43.

In stage 44 of the FIG. 3 embodiment of the invention, time delay $z^{-m}$ is applied to the output of $H_{ITF}$ filter 52 by delay element 55 of FIG. 7 and combined with outputs $x_{LL}(z)$ and $x_{RL}(z)$ of stage 43 in a summation element, and the output of this summation element is transformed in $H_{ETF}$ filter 50. Also, time delay $z^{-m}$ is applied to the output of $H_{ITF}$ filter 53 by delay element 56 of FIG. 7 and combined with outputs $x_{LR}(z)$ and $x_{RR}(z)$ of stage 43 in a second summation element, and the output of the second summation element is transformed in $H_{ETF}$ filter 51. Output $x_{LR}(z)$ of stage 43 is transformed in $H_{ITF}$ filter 52, and output $x_{RR}(z)$ of stage 43 is transformed in $H_{ITF}$ filter 53. In filters 50, 51, 52, and 53, the speaker angles are set to the position of the physical speakers. The delays ($z^{-m}$) are determined for the corresponding angles.

The crosstalk filter and equalization filters $H_{ITF}$ and $H_{ETF}$ have the following form:

$$H_{ITF}(z) = \frac{H_c(z)}{H_i(z)} = \frac{b_{c0} + b_{c1}z^{-1}}{b_{i0} + b_{i1}z^{-1}} = \frac{\frac{b_{c0}}{b_{i0}} + \frac{b_{c1}}{b_{i0}}z^{-1}}{1 + \frac{b_{i1}}{b_{i0}}z^{-1}} \tag{17}$$

$$H_{EQF}(z) = \frac{1}{H_i(z)} = \frac{a_0 + a_1z^{-1}}{b_{i0} + b_{i1}z^{-1}} = \frac{\frac{a_0}{b_{i0}} + \frac{a_1}{b_{i0}}z^{-1}}{1 + \frac{b_{i1}}{b_{i0}}z^{-1}} \tag{18}$$

with the a and b parameters as in equations (9)-(16) above.

If the sum of the signals input to element 30 (or 31) of FIG. 3 is greater than a maximum allowed level, clipping could occur. However, limiter 32 of FIG. 3 is used to avoid such clipping. The left surround output LS' of stage 44 is combined with amplified center channel input C and left front input L in left channel summation element 30, and the output of element 30 undergoes limiting in limiter 32 as shown in FIG. 3. The right surround output RS' of stage 44 is combined with amplified center channel input C and right front input R in right channel summation element 31, and the output of element 31 also undergoes limiting in limiter 32 as shown in FIG. 3. In response to the unlimited left output of element 30, limiter 32 generates the left output (L') that is asserted to the left front speaker. In response to the unlimited right output of element 31, limiter 32 generates the right output (R') that is asserted to the right front speaker.

Limiter 32 of FIG. 3 can be implemented as shown in FIG. 8. Limiter 32 of FIG. 8 has the same structure as the FIG. 4 implementation of dynamic range compression stage 41, and comprises RMS power determination element 170, smoothness determination element 171, gain calculation element 172, and amplification elements 173 and 174, connected as shown. Instead of raising the low levels of the inputs, amplification elements 173 and 174 of limiter 32 lower the signal peaks of the inputs (when the level of either one of the inputs is above a predetermined threshold). Typical attack and release times for limiter 32 of FIG. 8 are 22 ms and 50 ms, respectively. A typical value of the predetermined threshold employed in limiter 32 is 25% of full scale, and a typical compression ratio is 2:1 for amplification of each input when its level is above the threshold.

In some embodiments, the inventive virtualizer system is or includes a general purpose processor coupled to receive or to generate input data indicative of multiple audio input channels, and programmed with software (or firmware) and/or otherwise configured (e.g., in response to control data) to perform any of a variety of operations on the input data, including an embodiment of the inventive method. Such a general purpose processor would typically be coupled to an input device (e.g., a mouse and/or a keyboard), a memory, and a display device. For example, the FIG. 3 system could be implemented in a general purpose processor, with inputs C, L, R, LS, and RS being data indicative of center, left front, right front, left rear, and right rear audio input channels, and outputs L' and R' being output data indicative of output audio signals. A conventional digital-to-analog converter (DAC) could operate on this output data to generate analog versions of the output audio signals for reproduction by the pair of physical front speakers.

FIG. 9 is a block diagram of a virtualizer system 20, which is a programmable audio DSP that has been configured to perform an embodiment of the inventive method. System 20 includes programmable DSP circuitry 22 (a virtualizer subsystem of system 20) coupled to receive audio input signals indicative of sound from multiple source locations including at least two rear locations (e.g., five input signals C, L, LS RS, and R as indicated in FIG. 3). Circuitry 22 is configured in response to control data from control interface 21 to perform an embodiment of the inventive method, to generate left and right channel output audio signals L' and R', for reproduction by a pair of physical speakers, in response to the input audio signals. To program system 20, appropriate software is asserted from an external processor to control interface 21, and interface 21 asserts in response appropriate control data to circuitry 22 to configure the circuitry 22 to perform the inventive method.

In operation, an audio DSP that has been configured to perform surround sound virtualization in accordance with the invention (e.g., virtualizer system 20 of FIG. 9) is coupled to receive multiple audio input signals (indicative of sound from multiple source locations including at least two rear locations), and the DSP typically performs a variety of operations on the input audio in addition to (as well as) virtualization. In accordance with various embodiments of the invention, an audio DSP is operable to perform an embodiment of the inventive method after being configured (e.g., programmed) to generate output audio signals (for reproduction by a pair of physical speakers) in response to the input audio signals by performing the method on the input audio signals.

While specific embodiments of the present invention and applications of the invention have been described herein, it will be apparent to those of ordinary skill in the art that many variations on the embodiments and applications described herein are possible without departing from the scope of the invention described and claimed herein. It should be understood that while certain forms of the invention have been shown and described, the invention is not to be limited to the specific embodiments described and shown or the specific methods described.

What is claimed is:

1. A surround sound virtualization method for producing output signals for reproduction by a pair of physical speakers at physical locations relative to a listener, where none of the physical locations is a location in a set of rear source locations, said method including the steps of:

(a) in response to input audio signals indicative of sound from the rear source locations, generating surround signals useful for driving the speakers at the physical locations to emit sound that the listener perceives as emitting from said rear source locations, including by performing dynamic range compression on the input audio signals; and (b) generating the output signals in response to the surround signals and at least one other input audio signal, each said other input audio signal indicative of sound from a respective front source location, such that the output signals are useful for driving the speakers at the physical locations to emit sound that the listener perceives as emitting from the rear source locations and from each said front source location, wherein step (a) includes a step of generating the surround signals including by performing decorrelation on the input audio signals, wherein the dynamic range compression is performed by nonlinear amplification of the input audio signals so as to improve audibility of the sound from the rear source locations relative to the sound from each said front location during reproduction of the output signals by the speakers at the physical locations, and wherein at least one of the dynamic range compression or the decorrelation is performed so as to provide improved localization of the sound from the rear source locations, relative to sound from at least one said front source location, during reproduction of the output signals by the speakers at the physical locations.

2. The method of claim 1, wherein step (a) includes a step of performing the dynamic range compression including by amplifying each of the input audio signals having a level below a predetermined threshold in a nonlinear manner depending on the amount by which the level is below the threshold.

3. The method of claim 2, wherein the level is an average level, over a time window, of said each of the input audio signals.

4. The method of claim 1, wherein the physical speakers are front loudspeakers, the physical locations are in front of the listener, and step (a) includes the step of generating left and right surround signals in response to left and right rear input signals.

5. The method of claim 4, wherein step (b) includes the step of generating the output signals in response to the surround signals, and in response to a left input audio signal indicative of sound from a left front source location, a right input audio signal indicative of sound from a right front source location, and a center input audio signal indicative of sound from a center front source location.

6. The method of claim 5, wherein step (b) includes a step of generating a phantom center channel in response to the center input audio signal.

7. The method of claim 5, wherein step (a) includes a step of performing the dynamic range compression including by amplifying each of the input audio signals having a level below a predetermined threshold in a nonlinear manner depending on the amount by which the level is below the threshold.

8. The method of claim 1, wherein step (a) includes a step of generating the surround signals including by transforming the input audio signals in accordance with a head-related transfer function.

9. The method of claim 8, wherein the input audio signals are a left rear input signal indicative of sound from a left rear source and a right rear input signal indicative of sound from a right rear source, and step (a) includes the steps of:

transforming the left rear input signal in accordance with the head-related transfer function to generate a first virtualized audio signal indicative of sound from the left rear source as incident at a left ear of the listener and a second virtualized audio signal indicative of sound from the left rear source as incident at a right ear of the listener, and transforming the right rear input signal in accordance with the head-related transfer function to generate a third virtualized audio signal indicative of sound from the right rear source as incident at the left ear of the listener and a fourth virtualized audio signal indicative of sound from the right rear source as incident at the right ear of the listener.

10. The method of claim 1, wherein step (a) includes a step of generating the surround signals including by performing cross-talk cancellation on the input audio signals.

11. The method of claim 1, wherein the physical loudspeakers are headphones and step (a) is performed without performing cross-talk cancellation on the input audio signals.

12. The method of claim 1, wherein step (a) includes the steps of:

performing the dynamic range compression on the input audio signals to generate compressed audio signals;

performing decorrelation on the compressed audio signals to generate decorrelated audio signals;

transforming the decorrelated audio signals in accordance with a head-related transfer function to generate virtualized audio signals; and performing cross-talk cancellation on the virtualized audio signals to generate the surround signals.

13. A surround sound virtualization system configured to produce output signals for reproduction by a pair of physical speakers at physical locations relative to a listener, where none of the physical locations is a location in a set of rear source locations, including:

a surround virtualizer subsystem, coupled and configured to generate surround signals in response to input audio signals including by performing dynamic range compression on the input audio signals, wherein the input audio signals are indicative of sound from the rear source locations, and the surround signals are useful for driving the speakers at the physical locations to emit sound that the listener perceives as emitting from said rear source locations, wherein the surround virtualizer subsystem is configured to generate the surround signals including by performing decorrelation on the input audio signals; and a second subsystem, coupled and configured to generate the output signals in response to the surround signals and at least one other input audio signal, each said other input audio signal indicative of sound from a respective front source location, such that the output signals are useful for driving the speakers at the physical locations to emit sound that the listener perceives as emitting from the rear source locations and from each said front source location, wherein the surround virtualizer subsystem is configured to:

perform the dynamic range compression by nonlinearly amplifying the input audio signals so as to improve audibility of the sound from the rear source locations relative to the sound from each said front location during reproduction of the output signals by the speakers at the physical locations, and perform the dynamic range compression and the decorrelation such that at least one of said dynamic range compression or said decorrelation provides improved localization of sound from the rear source locations, relative to sound from at least one said front source location, during reproduction of the output signals by the speakers at the physical locations.

14. The system of claim 13, wherein the surround virtualizer subsystem is configured to perform the dynamic range compression including by amplifying each of the input audio signals having a level below a predetermined threshold in a nonlinear manner depending on the amount by which the level is below the threshold.

15. The system of claim 13, wherein said system is an audio digital signal processor, the surround virtualizer subsystem is coupled to receive the input audio signals, the second subsystem is coupled to the surround virtualizer subsystem to receive the surround signals, and the second subsystem is coupled to receive each said other input audio signal.

16. The system of claim 13, wherein the physical speakers are front loudspeakers, the physical locations are in front of the listener, the input audio signals are left and right rear input signals, and the surround virtualizer subsystem is configured to generate left and right surround signals in response to the left and right rear input signals.

17. The system of claim 16, wherein the second subsystem is configured to generate the output signals in response to the surround signals, and in response to a left input audio signal indicative of sound from a left front source location, a right input audio signal indicative of sound from a right front source location, and a center input audio signal indicative of sound from a center front source location.

18. The system of claim 17, wherein the second subsystem is configured to generate a phantom center channel in response to the center input audio signal.

19. The system of claim 17, wherein the surround virtualizer subsystem is configured to perform the dynamic range compression including by amplifying each of the input audio signals having a level below a predetermined threshold in a nonlinear manner depending on the amount by which the level is below the threshold.

20. The system of claim 13, wherein the surround virtualizer subsystem is configured to generate the surround signals including by transforming the input audio signals in accordance with a head-related transfer function.

21. The system of claim 13, wherein the surround virtualizer subsystem is configured to generate the surround signals including by performing cross-talk cancellation on the input audio signals.

22. The system of claim 13, wherein the physical speakers are headphones and the surround virtualizer subsystem is configured to generate the surround signals without performing cross-talk cancellation on the input audio signals.

23. The system of claim 13, wherein the surround virtualizer subsystem includes:

a compression stage coupled to receive the input audio signals and configured to perform the dynamic range compression on said input audio signals to generate compressed audio signals;

a decorrelation stage coupled and configured to perform decorrelation on the compressed audio signals to generate decorrelated audio signals;

a transform stage coupled and configured to transform the decorrelated audio signals in accordance with a head-related transfer function to generate virtualized audio signals; and a cross-talk cancellation stage coupled and configured to perform cross-talk cancellation on the virtualized audio signals to generate the surround signals.

24. The system of claim 23, wherein the input audio signals are a left rear input signal indicative of sound from a left rear source and a right rear input signal indicative of sound from a right rear source, the decorrelation stage is configured to generate a left decorrelated audio signal and a right decorrelated audio signal, the transform stage is configured to transform the left decorrelated audio signal in accordance with the head-related transfer function to generate a first virtualized audio signal indicative of sound from the left rear source as incident at a left ear of the listener and a second virtualized audio signal indicative of sound from the left rear source as incident at a right ear of the listener, and the transform stage is configured to transform the right decorrelated audio signal in accordance with the head-related transfer function to generate a third virtualized audio signal indicative of sound from the right rear source as incident at the left ear of the listener and a fourth virtualized audio signal indicative of sound from the right rear source as incident at the right ear of the listener.

* * * * *